US009573379B2

(12) United States Patent
Norasak et al.

(10) Patent No.: US 9,573,379 B2
(45) Date of Patent: Feb. 21, 2017

(54) AGITATING MEMBER FOR INK CARTRIDGE

(71) Applicant: FUNAI ELECTRIC CO., LTD., Osaka (JP)

(72) Inventors: Sam Norasak, Lexington, KY (US); Shane McKinney, Lexington, KY (US); Richard Warner, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 15/077,486

(22) Filed: Mar. 22, 2016

(65) Prior Publication Data

US 2016/0200102 A1 Jul. 14, 2016

Related U.S. Application Data

(63) Continuation of application No. 14/516,433, filed on Oct. 16, 2014, now Pat. No. 9,308,737.

(51) Int. Cl.

| | |
|---|---|
| ***B41J 2/19*** | (2006.01) |
| ***B41J 2/175*** | (2006.01) |
| ***B41J 2/14*** | (2006.01) |

(52) U.S. Cl.

CPC ..... *B41J 2/17563* (2013.01); *B41J 2/14088* (2013.01); *B41J 2/1753* (2013.01); *B41J 2/17513* (2013.01); *B41J 2/17553* (2013.01)

(58) Field of Classification Search

CPC ..... B41J 2/19; B41J 2/18; B41J 2/175; B41J 2/17513; B41J 2/17563; B41J 2002/14403

See application file for complete search history.

(56) References Cited

U.S. PATENT DOCUMENTS

| | | | | |
|---|---|---|---|---|
| 6,007,176 | A * | 12/1999 | Askren | B41J 2/14024 347/18 |
| 6,065,828 | A | 5/2000 | Lo et al. | |
| 6,554,413 | B2 | 4/2003 | Kubota | |
| 7,618,133 | B2 | 11/2009 | Kubo et al. | |
| 7,618,136 | B2 | 11/2009 | Inoue et al. | |

(Continued)

FOREIGN PATENT DOCUMENTS

| | | | |
|---|---|---|---|
| JP | H05-131645 | A | 5/1993 |
| JP | H09-309212 | A | 12/1997 |

(Continued)

*Primary Examiner* — Juanita D Jackson

(74) *Attorney, Agent, or Firm* — Amster, Rothstein & Ebenstein, LLP

(57) ABSTRACT

A printhead assembly for an inkjet printer has a ink filter tower portion that contains filtered ink and includes multiple, substantially parallel extending elements. Settling of ink in an ink filter tower could clog the printhead nozzles and lessen the print quality. Therefore, in order to prevent the settling of the ink in the ink filter tower of the present design, a free-floating weighted slider is installed within the ink filter tower. The weighted slider has a top bridging member and downward-pointing shafts that are movable within trenches formed between the extending elements. During a reciprocating motion of the printhead assembly, the slider moves in a direction opposite to the direction of the printhead assembly and thereby agitates the ink within the tower. In addition to sliding from side to side of the printhead assembly, the slider may also be designed to pivot about an upper axis as it moves to further agitate the ink.

20 Claims, 12 Drawing Sheets

(56) References Cited

U.S. PATENT DOCUMENTS

| | | | | |
|---|---|---|---|---|
| 7,708,394 | B2 | 5/2010 | Kawamura et al. | |
| 7,766,470 | B2 * | 8/2010 | Baker | B41J 2/17506 347/85 |
| 7,992,984 | B2 | 8/2011 | Toba et al. | |
| 8,070,272 | B2 | 12/2011 | Toba | |
| 8,714,717 | B2 | 5/2014 | Okina | |
| 9,308,737 | B1 | 4/2016 | Norasak et al. | |
| 2008/0165233 | A1 | 7/2008 | Lin et al. | |
| 2012/0033004 | A1 | 2/2012 | Shiono | |

FOREIGN PATENT DOCUMENTS

| | | | |
|---|---|---|---|
| JP | 2004-216761 | A | 8/2004 |
| JP | 2005-186494 | A | 7/2005 |
| JP | 2006-044153 | A | 2/2006 |
| JP | 2009-045944 | A | 3/2009 |

* cited by examiner

8"
8"
8"

AGITATING MEMBER FOR INK CARTRIDGE

CROSS-REFERENCE TO RELATED APPLICATION

The present application is a Continuation of U.S. patent application Ser. No. 14/516,433, filed on Oct. 16, 2014, now issued U.S. Pat. No. 9,308,737, the entire contents of which are incorporated by reference herein.

FIELD

The present invention relates generally to inkjet printers, and more particularly, to a printhead assembly for inkjet printers.

BACKGROUND

An ink jet printer typically includes a printhead and a carrier. The ink jet printhead can comprise a printhead body, nozzles, and corresponding ink ejection actuators, such as heaters on a printhead chip. The actuators cause ink to be ejected from the nozzles onto a print medium at selected ink dot locations within an image area. The carrier moves the printhead relative to the medium, while the ink dots are jetted onto selected pixel locations, such as by heating the ink at the nozzles.

In some such systems, the ink reservoir comprises a removable or separable tank, such that the tank can be separated from the printhead, and replaced or refilled, when the ink is low. The printhead components can then be re-used. In such ink tank systems, a separable fluid connection between the tank and the printhead body is needed, in contrast to systems where the printhead body is integral with the ink reservoir. The connection permits ink to flow to the nozzles from the tank, but is separable such that the ink tank can be removed when empty.

The printhead assembly may also include a filter within an ink passageway leading from the ink reservoir to the nozzles, for isolating any contaminants or debris from the ejectors and nozzles. A chamber located between the filter and the nozzle is referred to as the ink filter tower as it contains ink after it is filtered.

The inks that are typically used for ink jet printing include dye inks and pigment inks. A significant problem associated with the use of pigment inks has been the settling of particles in the bottom of the main ink reservoir(s) of a printhead when a printhead sits idle for a while. This problem is especially pronounced with pigment inks that are designed to set quickly onto a printed surface. The settling of the ink can cause nozzles on the printhead to become clogged and malfunction and may produce lighter coloration on a printed document.

Various approaches have been considered to mitigate the settling problem within the main ink reservoir of the cartridge before the filter. One approach involves installing floating balls or rods in the ink reservoir that can roll around within the reservoir to stir the ink when the printhead moves. A simpler approach is to remove the printhead from the printer and shake it.

However, none of these approaches adequately address the settling of ink within a printhead that has an ink filter tower. The filter towers currently have no moving parts that can agitate the ink. Shaking the printhead is not particularly effective for this purpose. Moreover, the ink filter tower is of a very compact size compared to the size of the ink reservoir.

It is therefore challenging to provide a suitable element for agitating the ink in an ink filter tower that would be effective and yet not get stuck and/or block the passageways through which the filtered ink flows to the nozzle.

SUMMARY OF THE INVENTION

Accordingly, it is an object of the present invention to provide a mechanism for agitating ink within an ink filter tower.

To satisfy this objective, a free-floating member, for example, a weighted slider, is incorporated into the ink filter tower of a printhead assembly. In an embodiment of the present invention, the ink filter tower has extending elements, for example, pillars, that extend laterally across the tower. Trenches are formed between these pillars. For a tower of this design, a slider includes a bridging member and a plurality of downward-pointed, substantially parallel shafts connected to the bridging member. In constructing the tower, the slider of this design is installed in a free-floating position with the bridging member situated above the extending elements and at least one of the shafts situated within a trench. The slider is weighted so that it remains approximately within the desired vertical position and is constrained by the location of the shaft(s) within the trench(es) to move in a substantially lateral direction within the ink filter tower. The ink within the ink filter tower serves as a lubricant for movement of the slider. During the reciprocating motion of the printhead assembly, the slider moves in a direction opposite to the direction of motion of the printhead assembly to agitate the filtered ink within the ink filter tower.

In an embodiment, the bridging member may comprise a bar with a flat upper surface and the shafts comprise columns of a rectangular cross-section. In another embodiment, the bridging member may comprise a curved upper surface and the shafts comprise columns of a rectangular cross-section. In yet another embodiment, the bridging member may be a rod that permits the slider to pivot and slide, and the slider shafts are rotatable along the axis formed by the rod.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein:

FIG. 6(*b*) is a top view of an ink filter tower with a slider shown in FIG. 5 illustrating the rightward motion of the slider when the printer carrier moves in a leftward direction;

DETAILED DESCRIPTION

Figure 1:
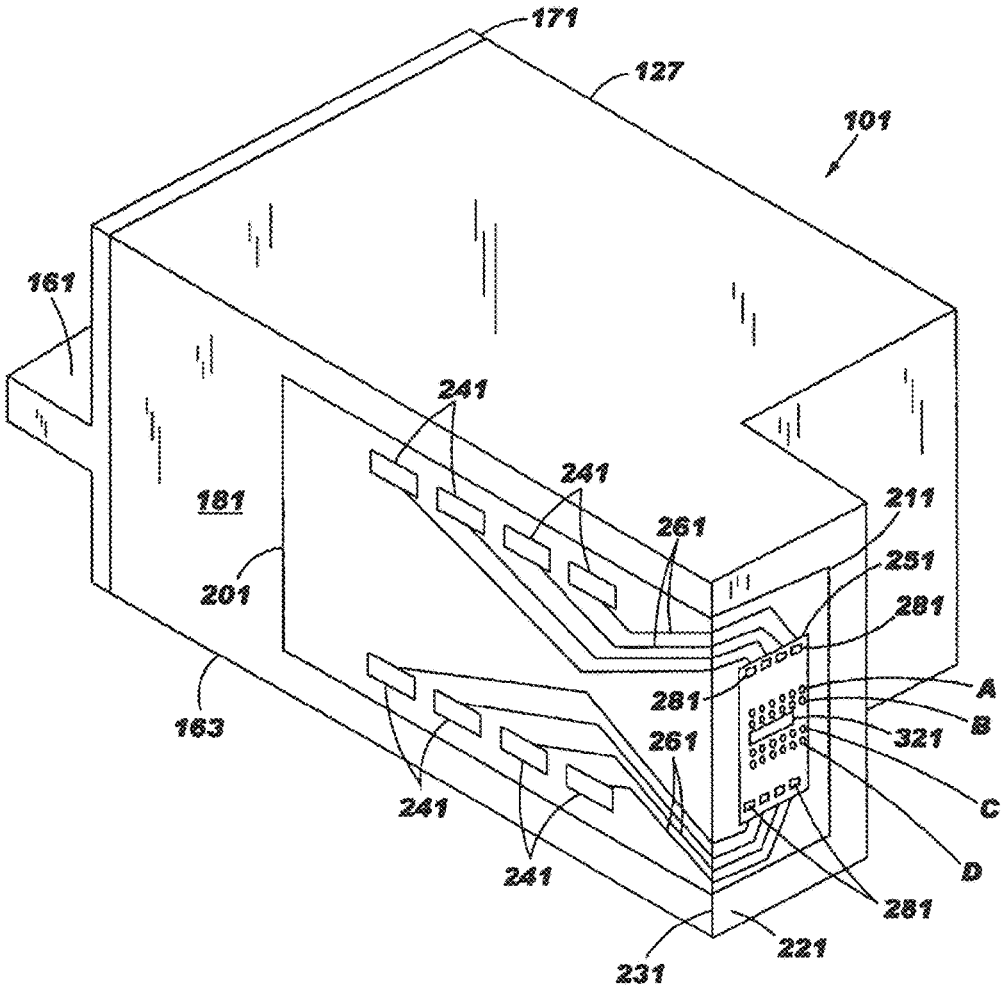
FIG. 1 is a perspective view of a conventional printhead.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

FIG. 1 shows an inkjet printhead generally designated by reference number 101. The printhead 101 has a housing 127 formed of a lid 161 and a body 163 assembled together through attachment or connection of a lid bottom surface and a body top surface at interface 171. The shape of the housing varies and depends upon the external device that carries or contains the printhead, the amount of ink to be contained in the printhead and whether the printhead contains one or more varieties of ink. In any embodiment, the housing or body has at least one compartment in an interior thereof for holding an initial or refillable supply of ink and a structure, such as a foam insert, lung or other, for maintaining appropriate backpressure in the inkjet printhead during use. In other embodiments, the compartment contains black ink, photo-ink and/or plurals of cyan, magenta or yellow ink. It will be appreciated that fluid connections (not shown) may exist to connect the compartment(s) to a remote source of bulk ink.

A portion 205 of a tape automated bond (TAB) circuit 201 adheres to one surface 181 of the housing while another portion 211 adheres to another surface 221. As shown, the two surfaces 181, 221 exist perpendicularly to one another about an edge 231. The TAB circuit 201 has a plurality of input/output (I/O) connectors 241 fabricated thereon for electrically connecting a heater chip 251 to an external device, such as a printer, fax machine, copier, photo-printer, plotter, all-in-one, etc., during use. Pluralities of electrical conductors 261 exist on the TAB circuit 201 to electrically connect and short the I/O connectors 241 to the bond pads 281 of the heater chip 251 and various manufacturing techniques are known for facilitating such connections. It will be appreciated that while eight I/O connectors 241, eight electrical conductors 261 and eight bond pads 281 are shown, any number are embraced herein. It is also to be appreciated that such number of connectors, conductors and bond pads may not be equal to one another.

The heater chip 251 contains at least one ink via 321 that fluidly connects to a supply of ink in an interior of the housing. Typically, the number of ink vias of the heater chip corresponds one-to-one with the number of ink types contained within the housing interior. The vias usually reside side-by-side or end-to-end. During printhead manufacturing, the heater chip 251 preferably attaches to the housing with any of a variety of adhesives, epoxies, etc. well known in the art. As shown, the heater chip contains four rows (rows A-row D) of fluid firing elements, especially resistive heating elements, or heaters. For simplicity, dots depict the heaters in the rows and typical printheads contain hundreds of heaters. It will be appreciated that the heaters of the heater chip preferably become formed as a series of thin film layers made via growth, deposition, masking, photolithography and/or etching or other processing steps. A nozzle plate, shown in other figures, with pluralities of nozzle holes adheres over or is fabricated with the heater chip during thin film processing such that the nozzle holes align with the heaters for ejecting ink during use. Alternatively, the heater chip is merely a semiconductor die that contains piezoelectric elements, as the fluid firing elements, for electromechanically ejecting ink. As broadly recited herein, however, the term heater chip will encompass both embodiments despite the name "heater" implying an electro-thermal ejection of ink. Even further, the entirety of the heater chip may be configured as a side-shooter structure instead of the roof-shooter structure shown.

Figure 2:
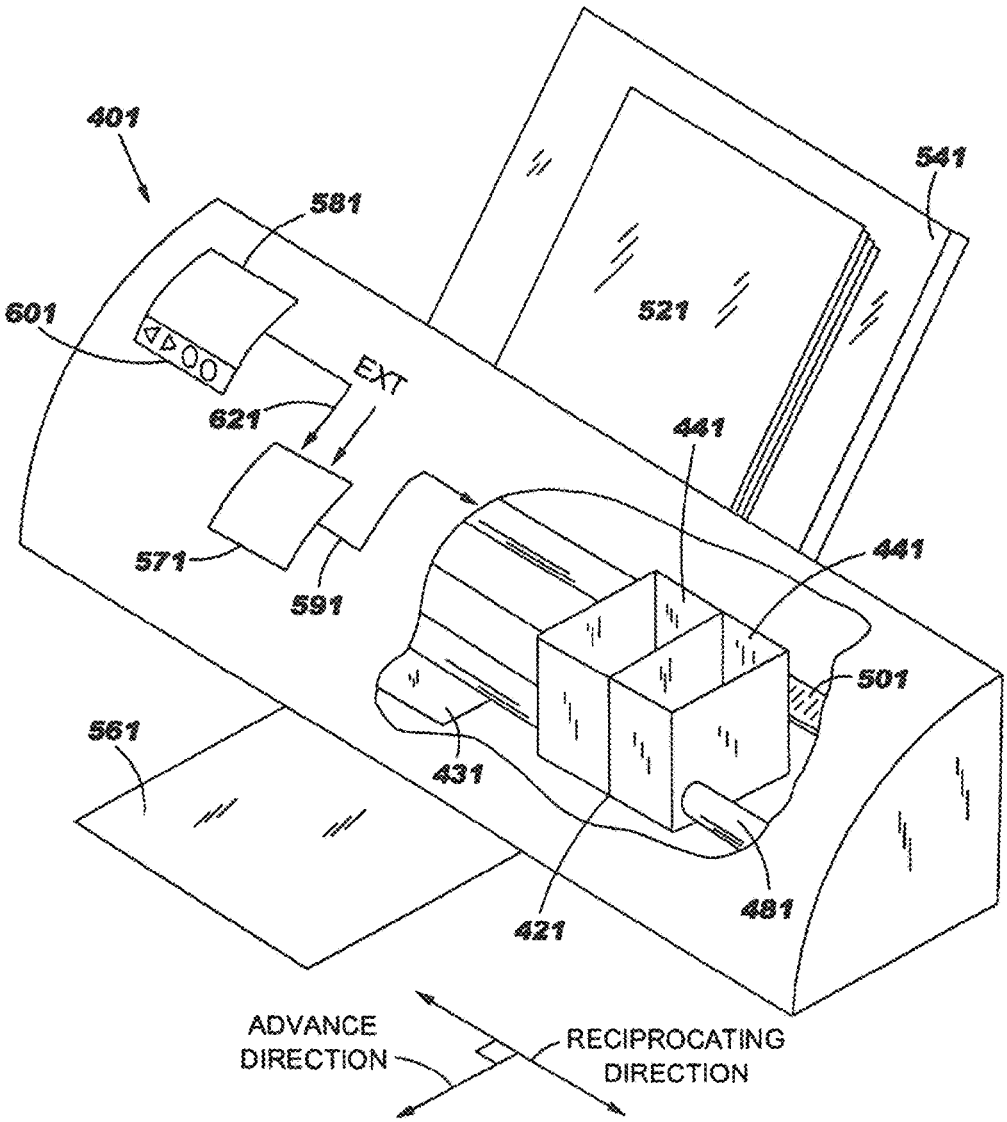
FIG. 2 is a perspective view of a conventional inkjet printer usable with the printhead assembly according to an exemplary embodiment of the present invention.

FIG. 2 shows an external device in the form of an inkjet printer for containing the printhead 101, generally designated by reference number 401. The printer 401 includes a carriage 421 having a plurality of slots 441 for containing one or more printheads. The carriage 421 is caused to reciprocate (via an output 591 of a controller 571) along a shaft 481 above a print zone 431 by a motive force supplied to a drive belt 501 as is well known in the art. The reciprocation of the carriage 421 is performed relative to a print medium, such as a sheet of paper 521, that is advanced in the printer 401 along a paper path from an input tray 541, through the print zone 431, to an output tray 561.

In the print zone, the carriage 421 reciprocates in the Reciprocating Direction generally perpendicularly to the paper Advance Direction as shown by the arrows. Ink drops from the printheads are caused to be ejected from the heater chip 251 (FIG. 1) at such times pursuant to commands of a printer microprocessor or other controller 571. The timing of the ink drop emissions corresponds to a pattern of pixels of the image being printed. Oftentimes, such patterns are generated in devices electrically connected to the controller (via EXT input) that are external to the printer such as a computer, a scanner, a camera, a visual display unit, a personal data assistant, or other. A control panel 581 having user selection interface 601 may also provide input 621 to the controller 571 to enable additional printer capabilities and robustness.

To print or emit a single drop of ink, the fluid firing elements (the dots of rows A-D, FIG. 1) are uniquely addressed with a small amount of current to rapidly heat a small volume of ink. This causes the ink to vaporize in a local ink chamber and be ejected through the nozzle plate towards the print medium. The fire pulse required to emit such ink drop may embody a single or a split firing pulse and is received at the heater chip on an input terminal (e.g., bond pad 281) from connections between the bond pad 281, the electrical conductors 261, the I/O connectors 241 and controller 571. Internal heater chip wiring conveys the fire pulse from the input terminal to one or many of the fluid firing elements.

Figure 3:
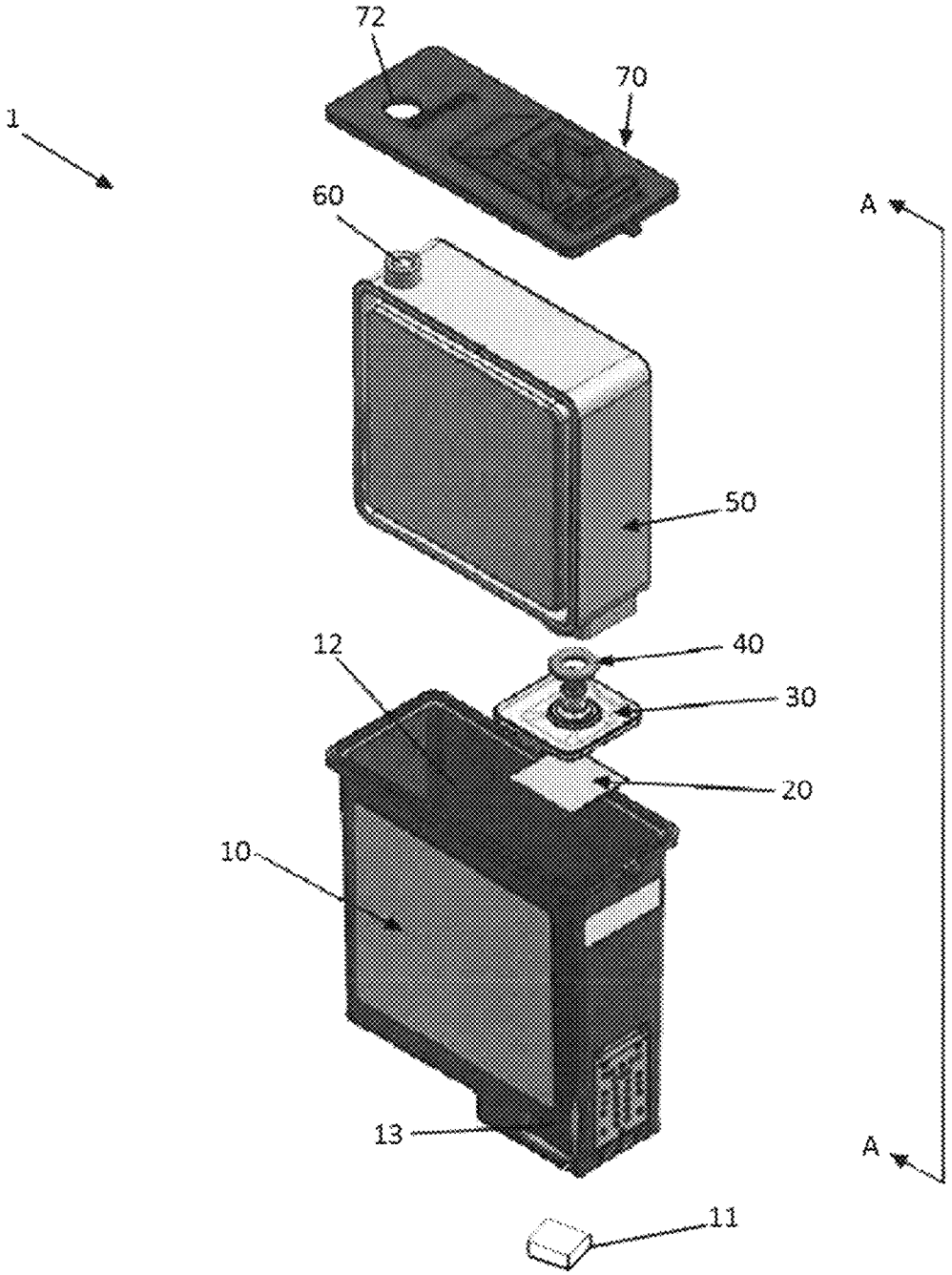
FIG. 3 is an exploded perspective view of a printhead assembly according to an exemplary embodiment of the present invention.
Figure 4:
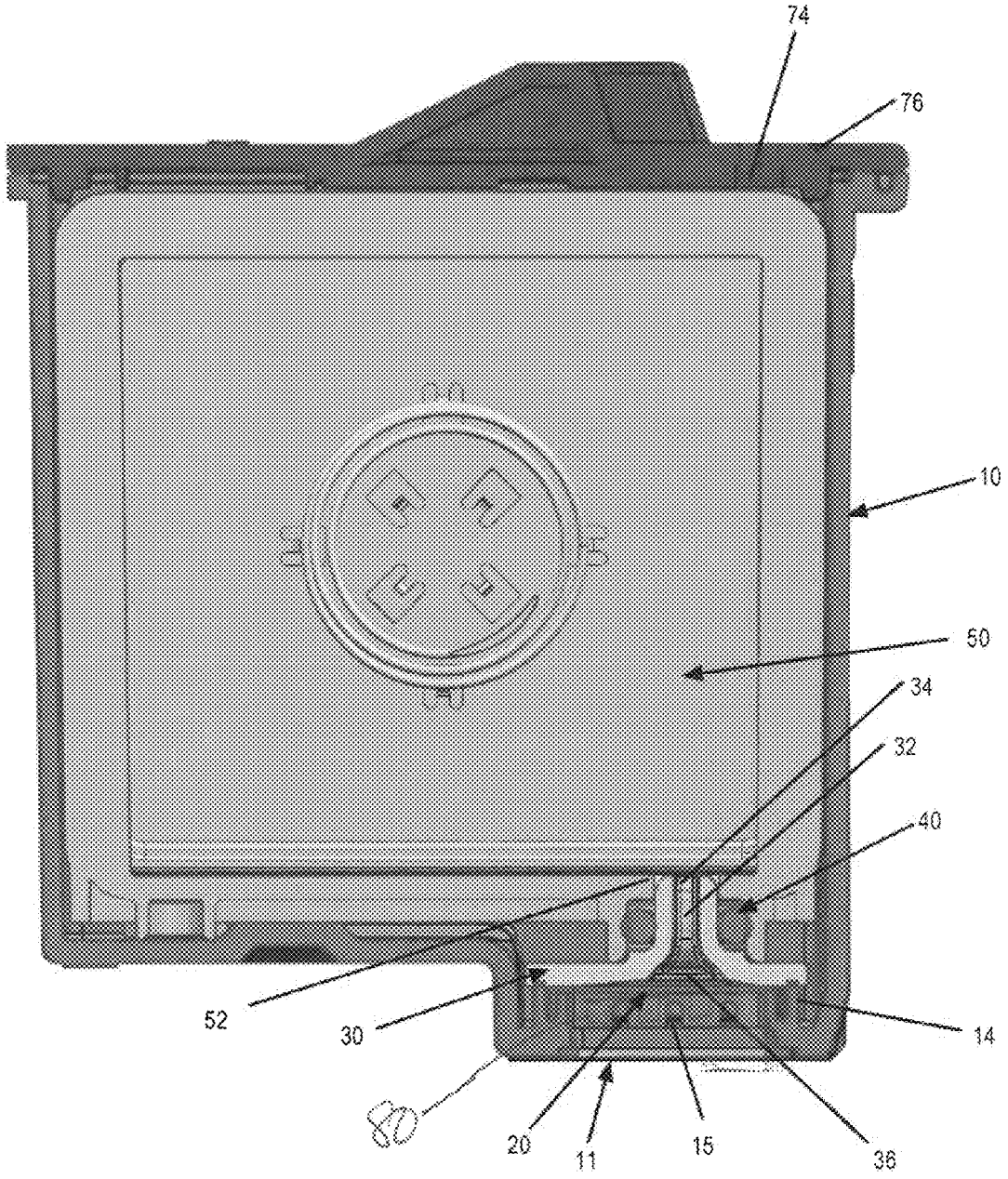
FIG. 4 is a cross-sectional view taken along the line A-A of FIG. 3.
Figure 5:
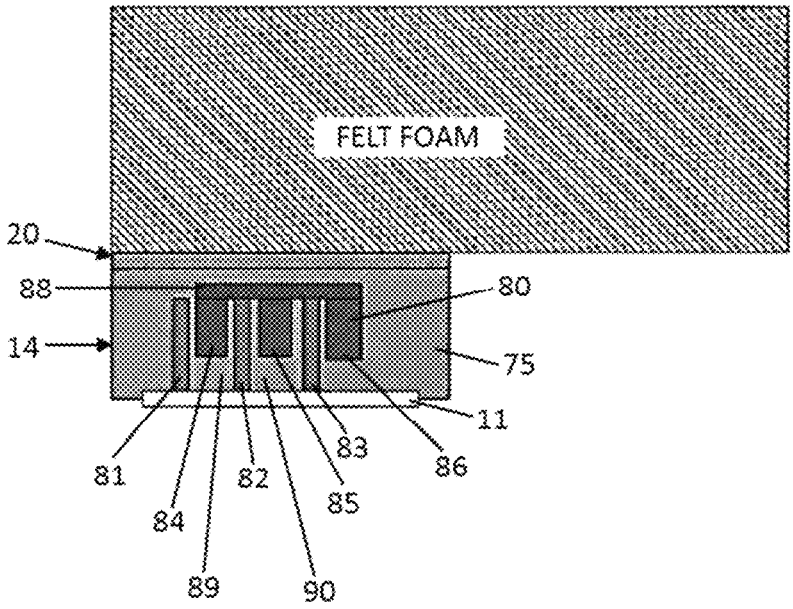
FIG. 5 is a side view of a portion of the printhead assembly of FIG. 3 depicting a slider according to an exemplary embodiment of the present invention.

FIG. 3 is an exploded perspective view and FIGS. 4 and 5 are cross-sectional views of a printhead assembly, generally designated as reference number 1, according to an exemplary embodiment of the present invention. The printhead assembly 1 includes an ink cartridge body 10, filter 20, filter cap 30, gasket 40, ink reservoir 50, fill ball 60 and lid 70. The ink cartridge body 10 has a chamber 12 that is sized and configured to receive the ink reservoir 50. Although only one ink reservoir 50 is shown in the figures, it should be appreciated that multiple ink reservoirs may be provided to accommodate one or more color inks. The ink reservoir 50 includes an exit port 52 for delivery of the ink, once installed in the chamber 12, and the port 52 can include an interface structure as appropriate, such as a lip or extension. The exit port 52 can be sealed using a removable seal, which can be removed at the time of installation.

Attached to the ink cartridge body 10 is a print head chip (or "nozzle plate") 11 including a plurality of nozzles for delivery of the ink to the print medium. In other embodiments, the nozzles are provided on a structure separate from the chip. The ink flows from the exit port 52 of the ink reservoir 50 through channels in the lower portion of the body 10. The ink then flows within the body 10 to a manifold in the print head chip 11, from which it is drawn to the nozzles for ejection onto the print medium, such as by using heater elements or piezoelectric elements formed in the chip 11. The system 1 is moved relative to the print medium, such that the nozzles drop ink at one or more desired locations on the medium.

The lower portion of the ink cartridge body 10 includes a tower 14 (or "ink filter tower"). The tower 14 may include any appropriate entrance passage, extension, structure, port, or interface for receiving ink for printing. The tower 14 of this example includes an ink raised tubular extension, or standpipe, having one or more openings 15 through which the ink may flow from the ink reservoir 50 to another reservoir formed by chamber 75 within tower 14. Multiple extending elements, for example, pillars 81, 82, 83, attached at the bottom of chamber 75, are spaced apart from, and substantially parallel to, one another. While only three pillars shown in FIG. 5, one skilled in the art will understand that, in this tower, there can be a different number of pillars that form, in essence, substantially parallel guiding elements for a free-floating member, such as a slider described below. The spaces between the rows of pillars can be described as defining "trenches."

As shown in FIG. 4, the filter cap 30 engages the tower 14, and in particular may be welded to an upstanding outer perimeter wall of the tower 14. The filter cap 30 includes a conduit or guide component for providing a passage between the ink cartridge body 10 and the ink reservoir 50. In this example, the filter cap 30 includes an inner passage 32 for providing ink therethrough, the passage 32 being defined by a smaller diameter upper passage portion 34 at the ink reservoir end and a larger diameter lower passage portion 36 at the ink cartridge body end. The filter cap 30 may be made of a polyamide, such as, for example, nylon, or other suitable materials that can provide a fluid resistant seal against the tower 14, ink cartridge body 10, and/or ink reservoir 50.

The upper passage portion 34 of the filter cap 30 engages a corresponding exit port 52 of the ink reservoir 50 to allow ink to flow from the ink reservoir 50 to the passage 32 of the filter cap 30. A sealing member is disposed adjacent the filter cap 30 and assists in sealing between the filter cap 30 and the ink reservoir 50. In this example, the sealing member includes the gasket 40 that engages the upper passage portion 34, so as to create a fluidic seal to control fluid and evaporative losses from the system, and prevent air from entering the system to maintain back pressure. The gasket 40 may be made of a suitable elastomer material, or other material with good sealing properties.

The filter 20 filters contaminants in the ink from reaching the printhead chip. The filter 20 can also provide capillary functions to allow ink to pass upon demand to the printhead chip and to prevent air passage into the printhead chip. The filter 20 can be made of a metal weave, a polymer weave, or other mesh, screen, or weave materials. For instance, a stainless steel dutch twill or a stainless steel random weave material may be used to form the filter 20. The filter 20 may be insert injection molded in the tower 14, or otherwise disposed in the ink cartridge body 10. As another example, the filter 20 may be heat staked to the ink cartridge body 10.

The material used to form the ink cartridge body 10 and associated lid 70 may be, for example, Nylon 6,6, Nylon 6, Nylon 6,12, polyethersulfone, polypropylene, polyethylene, and polyoxymethylene or other materials that are compatible with ketone, acetate and alcohol base inks. Since these materials exhibit vapor loss through permeation, a secondary boundary may be provided in the form of the ink reservoir 50. In this regard, the ink reservoir 50 may be made of polypropylene and/or polyethylene based materials so as to create a sufficient permeation barrier. The ink reservoir 50 is also provided with foam or felt materials. The ink reservoir 50 provides the primary permeation boundary for the ink cartridge body 10 and when the ink reservoir 50 is attached internally to the ink cartridge body 10 and lid 70, a tortuous vent path is created having a high length to area ratio. This tortuous path allows air to move through it, while maintaining a high humidity environment, which reduces evaporative losses and greatly reduces permeation from the system.

Referring to FIG. 5, ink filter tower 14 also has a free-floating member such as a metallic, weighted slider 80 installed within ink filter tower 14 in order to prevent ink from settling within tower 14. Slider 80 is free-floating in the sense that it is not physically connected to the other elements in tower 14. Slider 80 is installed in the ink filter tower before the welding of the ink filter 30 above ink filter tower 14. Thereafter, felt or foam is installed in ink filter reservoir 50 that is attached above ink filter 20. After the felt or foam is installed, ink is injected into the reservoir and passes into the ink filter tower.

Slider 80 is generally comprised of a bridging member 88, such as a connecting bar or rod at its upper side, and multiple rectangular-shaped vertical shafts 84, 85, 86 formed integrally with the bridging member 88 that connects the shafts.

Shafts 84, 85, and 86, which are typically sealed and may be solid or have a hollow core, protrude downward from the bridging member such that they are substantially parallel to one another. The slider shafts, while substantially parallel, need not be of equal width. It is, indeed, desirable that the slider shafts are dimensioned to be as large as possible both within and outside the trenches such that the ink is agitated as much as possible while the slider can still free-float.

Slider 80 is positioned in ink filter tower 14 so that at least some of the shafts 84, 85 are situated within trenches 89, 90 while one or more shafts, such as shaft 86 may sit in chamber 75 adjacent passage 83 but outside of the trenches. The configuration and weight of the bridging member 88 and the shafts constrains slider 80 in a free-floating position relative to the pillars to enable substantially lateral movement from side to side of the printhead assembly without twisting or getting stuck. The ink in chamber 75 acts as a lubricant that enables the slider to move from side to side back and forth within the ink filter tower, but the viscosity of the ink also slows the movement of the slider so that it does not move too rapidly.

Figures 6A, 6B:
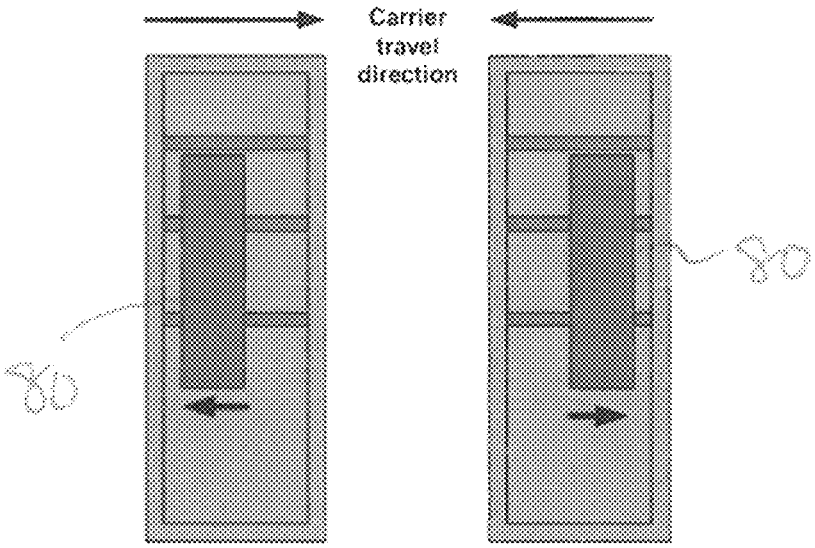
FIG. 6(*a*) is a top view of an ink filter tower with a slider shown in FIG. 5 illustrating the leftward motion of the slider when the printer carrier moves in a rightward direction.

The movement of slider 80 from side to side is initiated by the reciprocating motion of the printhead carrier during printing. The direction of motion of the slider 80 is opposite to the direction of motion of the printhead assembly. Thus, as illustrated in FIG. 6(*a*), when the carrier moves to the right, slider 80 moves to the left. Likewise, as illustrated in FIG. 6(*b*), when the carrier moves to the left, slider 80 moves to the right. This helps to agitate the ink within the ink filter tower, including the ink near and around the nozzle plate area, to mitigate the settling of ink that would otherwise occur. The ink agitation also helps to mix the ink that may have already settled, such as after a period of non-use of the printer.

In terms of speed, the carrier of an inkjet printer may move at, for example, 30 inches/second and generate 600 pixels/inch. This enables a carrier to function at around 18 kHz=(30 inches/second)×(600 pixels/inch)=18,000 pixels/second. At these carrier speeds, a slider may move in a direction opposite to the reciprocating direction of the carrier at, for example, 14-15 inches/second. In addition to the carrier speed, the speed of the slider may depend on factors such as the weight of the slider and the composition of the ink. However, the actual speed of slider movement is not limited to any particular value.

An ink filter tower of this design is particularly useful for pigmented inks where ink settling is a problem. Currently, only mono ink, i.e., black ink, is typically pigmented for use with inkjet printers. However, the present invention would also be useful with pigmented ink of other colors.

Slider 80 may be formed from a metallic material, such as stainless steel, and may be encapsulated or coated so as to prevent the metal from being in direct contact with the ink, should the ink used deleteriously interact with the metal.

The slider 80 is weighted so as to promote movement of the slider within the ink filter tower. In an embodiment, the weight of the slider is approximately in the range of 0.45 to 0.5 grams.

Figure 7:
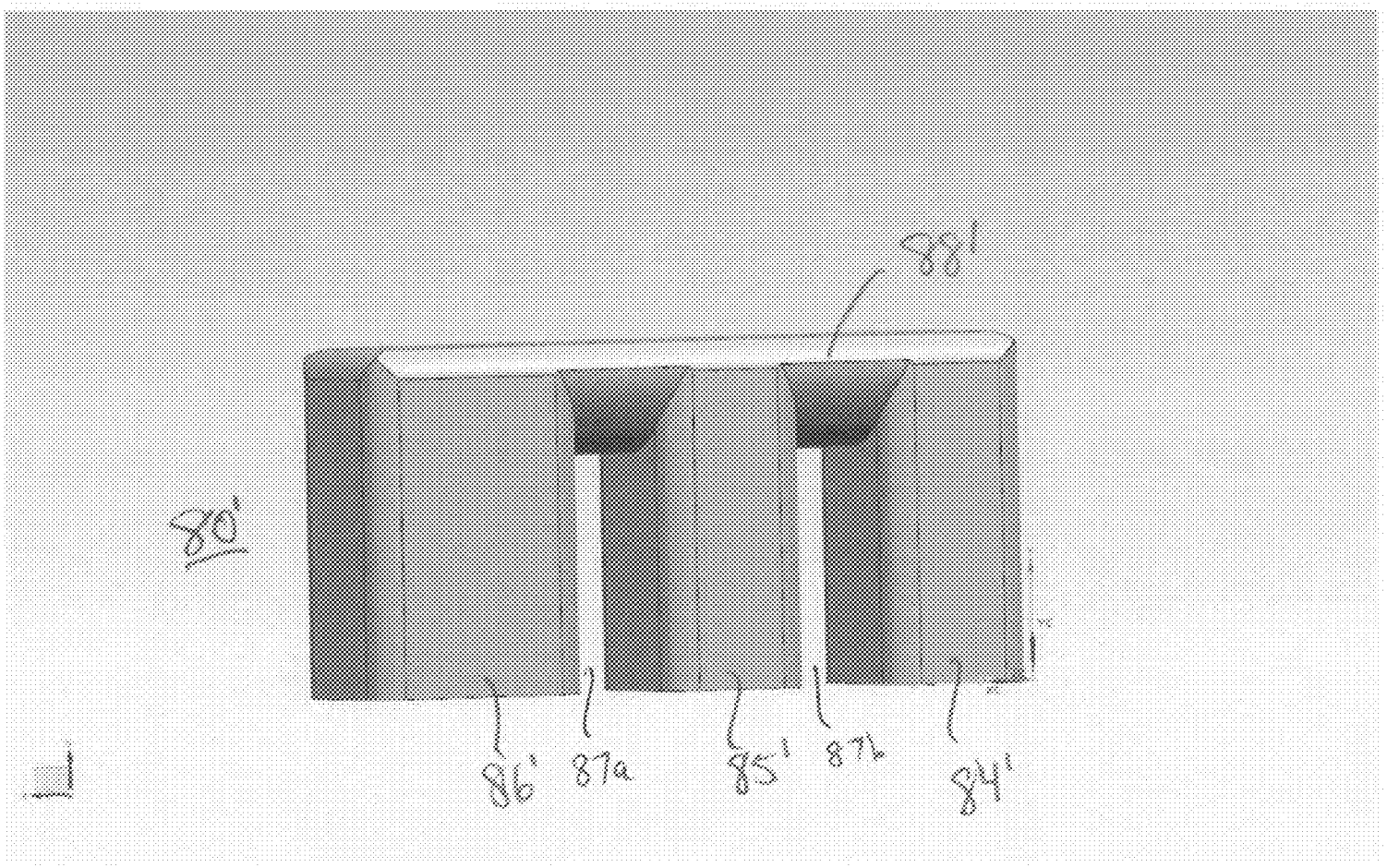
FIG. 7 is a perspective view of a first embodiment of a slider having a flat top in accordance with the present invention.

FIG. 7 shows a perspective view of a first embodiment of slider 80 according to the present invention. In this embodiment, slider 80' has a bridging member with a substantially flat upper surface 88' and downward-facing shafts 84', 85', and 86' separated by channels 87*a*, 87*b*. It can be seen that these shafts are columnar in shape with a rectangular cross-section. Shaft 86' may be wider than shafts 84' and 85'. This may be desirable where shaft 86' is positioned outside of a trench and there is space within chamber 75 to accommodate a shaft of a larger cross-section for maximum agitation of the ink. In the illustrated embodiment, the perimeters of the bridging member 81' and the vertical edges of the shafts may be beveled to enhance the motion of the slider and prevent the slider from getting stuck.

Figure 8:
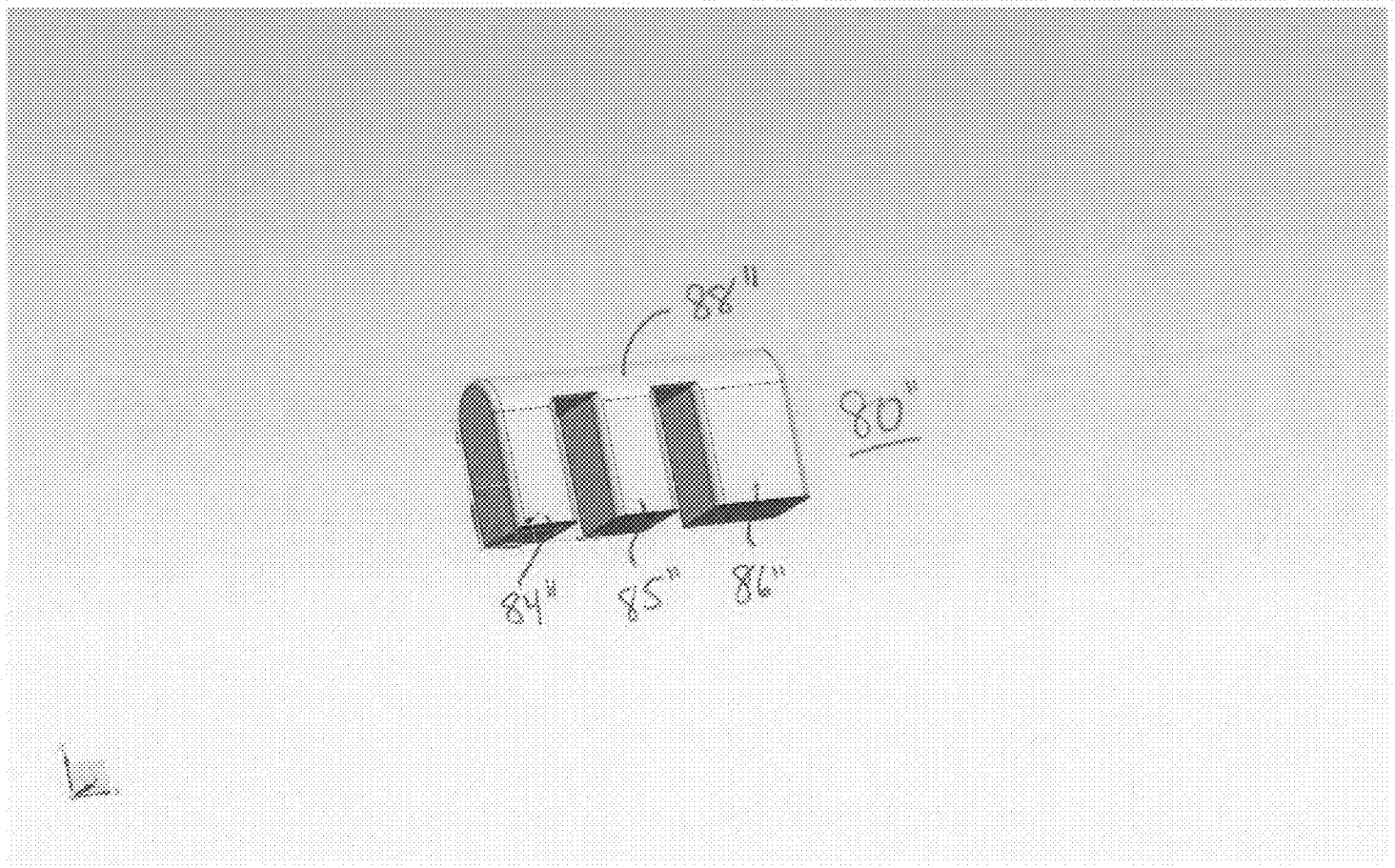
FIG. 8 is a perspective view of a second embodiment of a slider having a curved top in accordance with the present invention.

FIG. 8 shows a perspective view of a second embodiment of slider 80 according to the present invention. In this embodiment, slider 80" has a bridging member with a curved upper surface 88" and shafts 84", 85" and 86" that are columnar in shape with a rectangular cross-section. As with the embodiment shown in FIG. 7, shaft 86" may be wider than shafts 84" and 85" and the edges of the slider 80" may be beveled.

Figure 9:
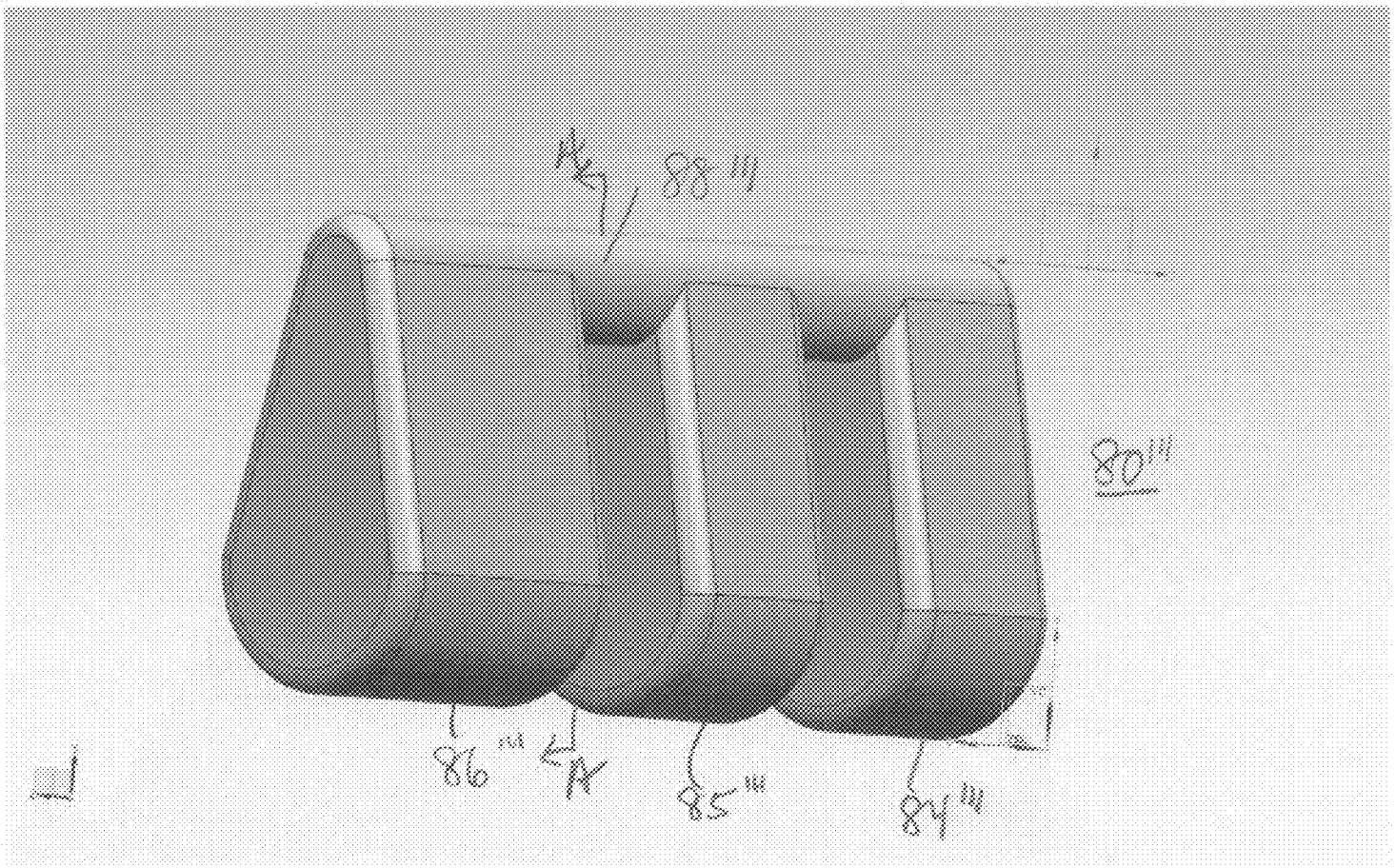
FIG. 9 is a perspective view of a third embodiment of a slider in the shape of a cam shaft in accordance with the present invention.
Figure 10:
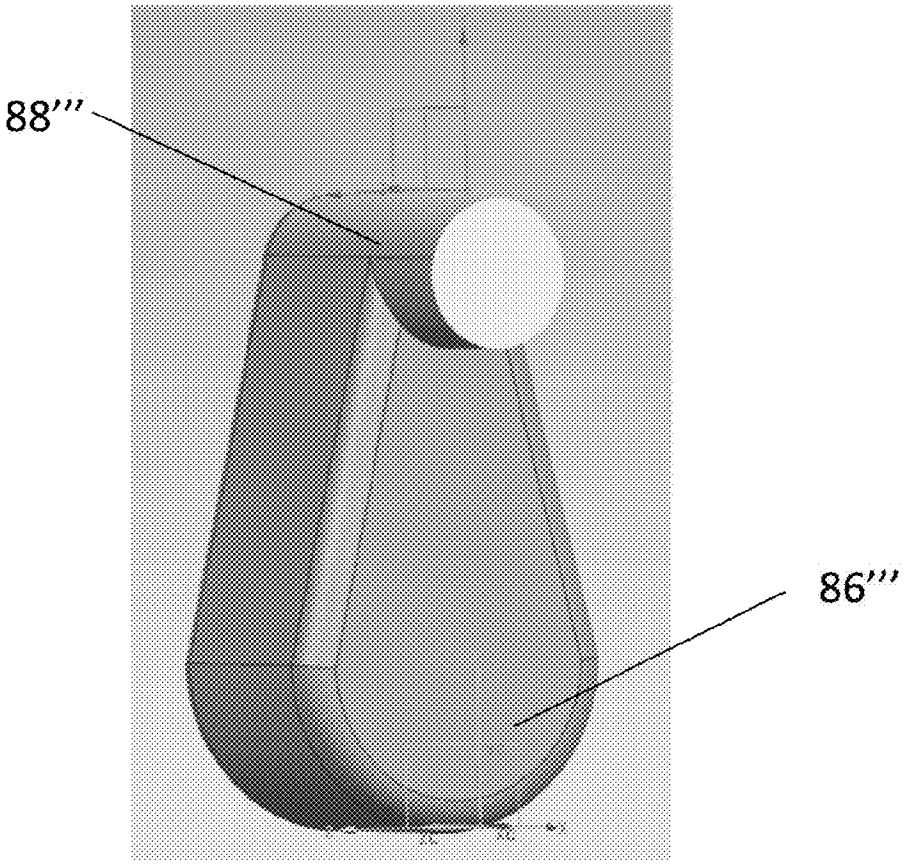
FIG. 10 is a cross-sectional view taken along line B-B of FIG. 9.

FIG. 9 shows a perspective view of a third embodiment of slider 80 according to the present invention. In this embodiment, slider 80''' is shaped as a cam shaft where bridging member 88''' is a rod and shafts 84''', 85''' and 86∝0" are shaped as circular sectors in cross-section. The side walls of 84''', 85''' and 86''' remain substantially parallel to one another. This design adds an additional degree of freedom to the motion of the free-floating slider so that the slider 88''' not only slides across the pillars 81, 82, 83 but can also pivot about the axis formed by rod 88''', to increase the agitation of the ink and prevent settling thereof. FIG. 10 shows a perspective view of the slider 80''' according to the third embodiment as viewed at line A-A of FIG. 9.

FIGS. 11 to 13 shows examples of possible dimensions (in units of mm) for the three different embodiments of a slider 80, shown in FIGS. 7 to 9.

Figure 11A:
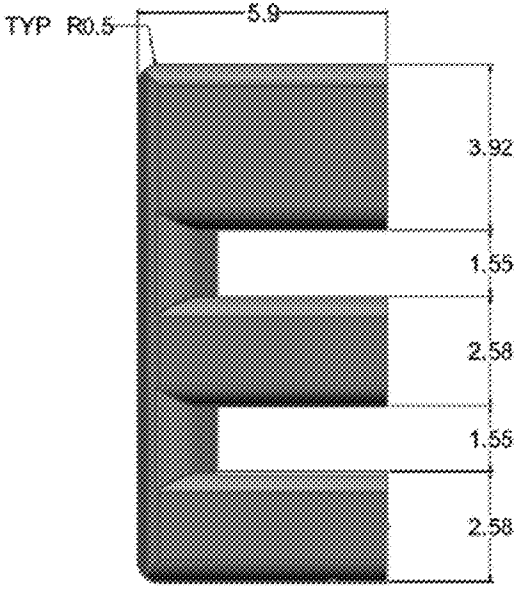
FIG. 11A is a side elevational view of the slider of FIG. 7 in accordance with the first embodiment of the present invention.
Figure 11B:
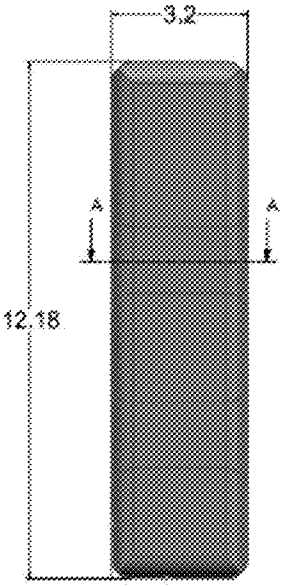
FIG. 11B is a top view of the slider of FIG. 11A.
Figure 11C:
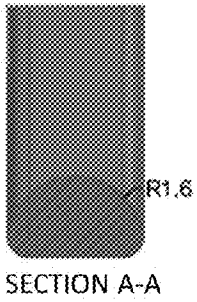
FIG. 11C is a cross-sectional view of the slider along line A-A of FIG. 11B.

FIG. 11A is a side elevational view of the slider of FIG. 7 in accordance with the first embodiment of the present invention. FIG. 11B is a top view of the slider of FIG. 11A. FIG. 11C is a cross-sectional view of the slider along line A-A of FIG. 11B.

Figure 12B:
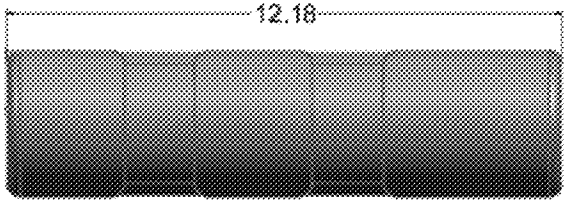
FIG. 12B is a top view of the slider of FIG. 12A.
Figure 12A:
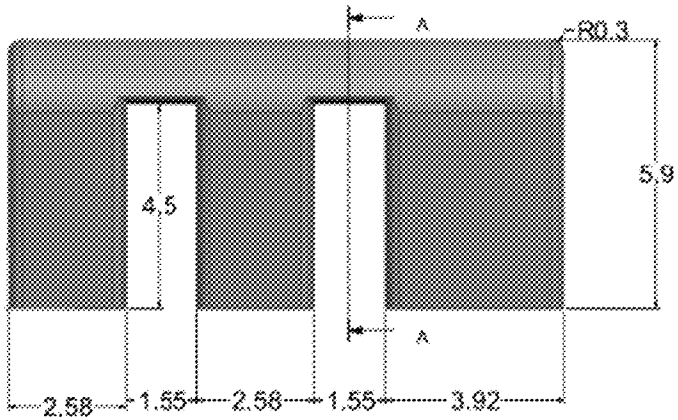
FIG. 12A is a side elevational view of the slider of FIG. 8 in accordance with a second embodiment of the present invention.
Figure 12D:
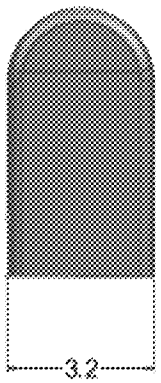
FIG. 12D is a side view of the slider of FIG. 12A.
Figure 12C:
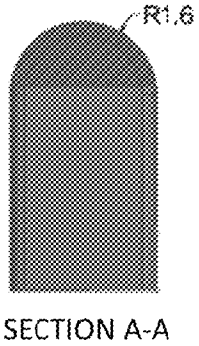
FIG. 12C is a cross-sectional view of the slider along line A-A of FIG. 12A.

FIG. 12A is a side elevational view of the slider of FIG. 8 in accordance with a second embodiment of the present invention. FIG. 12B is a top view of the slider of FIG. 12A. FIG. 12C is a cross-sectional view of the slider along line A-A of FIG. 12A. FIG. 12D is a side view of the slider of FIG. 12A.

Figure 13B:
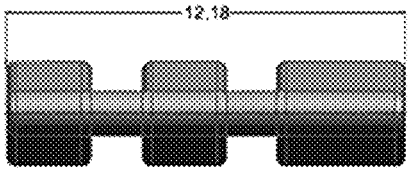
FIG. 13B is a top view of the slider of FIG. 13A.
Figure 13C:
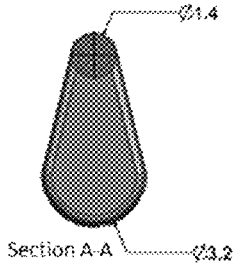
FIG. 13C is a cross-sectional view of the slider along line A-A of FIG. 13A.
Figure 13D:
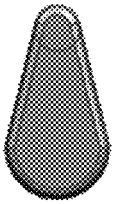
FIG. 13D is a side view of the slider of FIG. 13A.
Figure 13A:
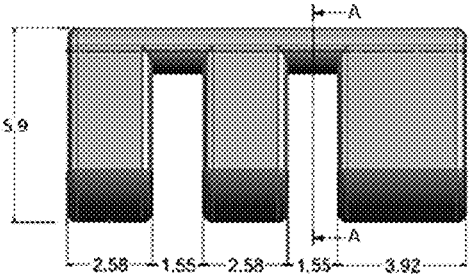
FIG. 13A is a side elevational view of the slider of FIG. 9 in accordance with a third embodiment of the present invention.

FIG. 13A is a side elevational view of the slider of FIG. 9 in accordance with a third embodiment of the present invention. FIG. 13B is a top view of the slider of FIG. 13A. FIG. 13C is a cross-sectional view of the slider along line A-A of FIG. 13A. FIG. 13D is a side view of the slider of FIG. 13A.

The present invention thus serves to agitate the ink in the ink filter tower, and thereby reduces nozzle outages on the printhead assembly and enables a darker coloration of the printed samples.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. An inkjet printhead, comprising:

a housing comprising at least one interior compartment configured to hold a supply of ink;

a heater chip fluidly coupled with the supply of ink and configured to eject ink;

a tower disposed in fluid communication between the interior compartment of the housing and the heater chip, the tower comprising an interior chamber and defining a plurality of pillars extending in a first direction opposite a second direction along which ink is ejected from the heater chip; and a slider disposed within the interior chamber of the tower, the slider comprising a plurality of shafts extending in the second direction and spaced apart such that the plurality of shafts of the slider are disposed in alternating relation with the respective plurality of pillars of the tower.

2. The inkjet printhead of claim 1, wherein the plurality of shafts of the slider and the plurality of pillars of the tower are spaced apart along a third direction transverse to both the first direction and the second direction, and wherein the slider is movable within the tower along the third direction.

3. The inkjet printhead of claim 1, wherein the plurality of shafts of the slider and the plurality of pillars of the tower are spaced apart along a third direction transverse to both the first direction and the second direction, and wherein at least one shaft of the slider defines a width along the third direction that is different than a width defined along the third direction by at least one other shaft of the slider.

4. The inkjet printhead of claim 3, wherein the at least one shaft is disposed adjacent an end of the tower, and the at least one other shaft is disposed adjacent an opposite end of the tower.

5. The inkjet printhead of claim 1, wherein the plurality of shafts of the slider and the plurality of pillars of the tower are spaced apart along a third direction transverse to both the first direction and the second direction, and wherein adjacent shafts of the slider are spaced apart at intervals of a greater distance along the third direction than a width of respective pillars of the tower along the third direction.

6. The inkjet printhead of claim 1, wherein the plurality of pillars comprises at least three pillars.

7. The inkjet printhead of claim 1, wherein the plurality of pillars are integrally formed with the tower.

8. The inkjet printhead of claim 1, wherein the slider is freely movable with respect to the tower.

9. The inkjet printhead of claim 1, wherein the plurality of shafts of the slider and the plurality of pillars of the tower are spaced apart along a third direction transverse to both the first direction and the second direction, wherein the first, second, and third directions all extend along a common plane, and wherein the slider is movable within the tower along a fourth direction that is transverse to the common plane.

10. The inkjet printhead of claim 1, wherein the plurality of shafts of the slider are interconnected by a bridging member.

11. The inkjet printhead of claim 10, wherein the bridging member comprises a flat upper surface.

12. The inkjet printhead of claim 10, wherein the bridging member comprises a curved upper surface.

13. The inkjet printhead of claim 10, wherein the bridging member has a circular cross-sectional profile.

14. The inkjet printhead of claim 1, wherein at least one shaft of the slider has a rectangular cross-sectional profile.

15. The inkjet printhead of claim 1, wherein at least one shaft of the slider has a circular cross-sectional profile.

16. The inkjet printhead of claim 1, wherein at least one shaft of the slider has a teardrop-shaped cross-sectional profile.

17. The inkjet printhead of claim 1, further comprising a filter cap engaged with the tower and configured to filter ink entering the interior chamber of the tower from the interior compartment of the housing.

18. An inkjet printer, comprising:

a movable carrier supporting at least one printhead, the at least one printhead comprising:

a housing comprising at least one interior compartment configured to hold a supply of ink;

a heater chip fluidly coupled with the supply of ink and configured to eject ink;

a tower disposed in fluid communication between the interior compartment of the housing and the heater chip, the tower comprising an interior chamber and defining a plurality of pillars extending in a first direction opposite a second direction along which ink is ejected from the heater chip; and a slider disposed within the interior chamber of the tower, the slider comprising a plurality of shafts extending in the second direction and spaced apart such that the plurality of shafts of the slider are disposed in alternating relation with the respective plurality of pillars of the tower.

19. The inkjet printer of claim 18, wherein at least one shaft of the slider has a rectangular cross-sectional profile.

20. The inkjet printer of claim 18, wherein at least one shaft of the slider has a circular cross-sectional profile.

* * * * *